US007654026B2

(12) United States Patent
Pitcher et al.

(10) Patent No.: US 7,654,026 B2
(45) Date of Patent: Feb. 2, 2010

(54) SNAP FRAME GRAPHIC DISPLAY ARRANGEMENT

(75) Inventors: David E. Pitcher, Swampscott, MA (US); Rebecca C. Suciu, Lynn, MA (US); Thomas P. Burrous, Haverhill, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 0 days.

(21) Appl. No.: 11/986,689

(22) Filed: Nov. 26, 2007

(65) Prior Publication Data

US 2009/0133306 A1 May 28, 2009

(51) Int. Cl.
*A47G 1/06* (2006.01)

(52) U.S. Cl. ..... 40/793; 40/792; 40/794; 40/795

(58) Field of Classification Search ..... 40/661.03, 40/792–795; 24/487
See application file for complete search history.

(56) References Cited

U.S. PATENT DOCUMENTS 3,602,943 A * 9/1971 Neuville et al. ..... 425/381.2
4,145,828 A * 3/1979 Hillstrom ..... 40/793
4,523,400 A * 6/1985 Seely ..... 40/791
4,958,458 A * 9/1990 Hillstrom et al. ..... 40/793
5,307,575 A * 5/1994 Ivansson et al. ..... 40/793
5,950,343 A * 9/1999 Dingle ..... 40/793
6,061,882 A * 5/2000 Otte-Wiese ..... 24/487
6,553,705 B2 * 4/2003 Geiberger et al. ..... 40/793
6,678,982 B2 * 1/2004 Pitcher et al. ..... 40/793
6,880,280 B2 * 4/2005 Burrous et al. ..... 40/793
7,076,899 B2 * 7/2006 Pitcher et al. ..... 40/611.02
7,370,448 B2 * 5/2008 Burrous et al. ..... 40/611.02

* cited by examiner

*Primary Examiner*—Paul N Dickson
*Assistant Examiner*—Shin Kim
(74) *Attorney, Agent, or Firm*—Don Halgren

(57) ABSTRACT

An elongated extruded snap frame member for biasedly removably capturing a display graphic for support and display thereof. The frame member comprises an elongated extruded frame receiving panel, an elongated strip of securement material applied to the frame panel at the time of extrusion and an articulable housing comprised of a cover and a plurality of articulable legs co-extruded with one another and connected to one another by a flexible web of material. A further flexible web of material connects the cover to a portion of the articulable housing, the further web of flexible material providing an axis of rotation for the cover when the cover is biasedly rotated onto the display graphic.

8 Claims, 7 Drawing Sheets

SNAP FRAME GRAPHIC DISPLAY ARRANGEMENT

BACKGROUND OF THE INVENTION

1. Field of the Invention

This invention relates to frame members for utilization as a graphic display tool, and more particularly to a frame and assembly thereof, utilizable with multiple hinge points to provide a range of bias on a graphic thereattached.

2. Prior Art

Graphic display frames have been utilized by the merchandising industry for many years. Those frames comprise rails which are assembled around a backer board or a graphic sheet which may be as thick as a backer board. Patents on such frames may be seen for example in U.S. Pat. Nos. 4,512,094, 4,512,095 or 4,523,400. As an example of that prior art, their limitations include difficulty in the attachment of the backer board to the elongated rails during assembly. Other concerns of the prior art include limitations where the graphic sheet and/or backer board have to be a particular thickness. In other words, there is a particular defined space in the frame rail which limits the graphic sheet and/or backer board to one thickness, and it can not be thinner or thicker.

It is an object of the present invention to overcome the disadvantages of the prior art.

It is a further object of the present invention to provide a frame rail assembly which can be initially manufactured using a range of backer board thicknesses and/or graphic displays thereon. This is made possible because of an assembly that utilizes adhesion rather than the rail geometry to hold the backer board or graphic (in the case of no backer board being utilized) in place.

It is still yet a further object of the present invention to provide an extruded frame rail which may be utilized with minimal assembly requirements because of the built-in co-extruded spring and the tape that is applied to the rail at the time of extrusion.

BRIEF SUMMARY OF THE INVENTION

The present invention comprises a snap frame assembly comprised of multiple snap frame members, which are attached to a backer board or graphic display (in the absence of a backer board) using adhesive. This assembly process allows for the initial manufacture of the frame with a range of backer board or graphic display thicknesses.

An elongated extruded snap frame member comprises an elongated linear frame panel having a co-extruded third leg perpendicular thereto. The frame panel and third leg comprise a portion of an elongated housing comprising an open-channel of generally "T"-shape in cross section, the open channel being defined by a first flange and a spaced apart second flange parallel with a bridging member. The bridging member has one elongated side thereof attached to a portion of the third leg, the bridging member having a second elongated edge connected to a third flange.

A generally "J"-shaped cover is co-extruded with the third flange, having a co-extruded web of flexible material comprising a living hinge therebetween. A first leg extends generally perpendicularly from an inner side of the J-shaped cover and is hingedly coupled by a flexible web with a center hinge leg which center hinge leg is also flexibly coupled by a flexible web, to the distal end of the third leg.

The first leg, the third leg, and the center (second) hinge leg are all pivotable with respect to one another, each leg being connected by the flexible web of material comprising an elongated joint or living hinge therebetween.

The J-shaped cover member has a distal edge with a distal leg angularly disposed thereon. The distal leg has an elongated distalmost edge comprised of flexible material thereon, which edge provides resilience and gripping power thereat, when the cover is in engagement with a graphic display discussed hereinbelow.

The elongated snap frame is preferably formed by a co-extrusion of rigid and flexible plastic material. The securement material, which is applied at the same time as the extrusion process, may for example comprise an adhesive or a tape or a multi-layer of adhesive and a flexible strip cover thereon.

Upon extrusion of a desired elongated length of the snap frame and application of the securement material, the rails are ready to be cut to size in preparation for receiving a graphic display or preferably a backer board thereon. Such backer board may be secured to the adhesive material on the upper or face side of the frame panel. A graphic display sheet may be placed upon the uppermost or face surface of the backer board so as to present that display to a viewing public.

Rotation of the cover and particularly the distal edge, towards the graphic display and backer board placed on the elongated extruded frame panel, effects bending of the three webs of flexure material, its axes of rotation consisting of the web of flexible material between the proximal end of the J-shaped cover and the third flange. The first leg and the center hinge leg, during that cover rotation, move from a generally perpendicular configuration to a generally planar configuration with flexure at its juncture of the webs of flexible material connectively co-extruded therebetween. The center hinge leg flexes with respect to the third leg at its juncture of webbed flexible material therebetween, so as to come into a generally parallel relationship therebetween. This simultaneous counter rotational motion of the first leg, the center hinge leg and the proximal portion of the "J" shaped cover about a three point hinge arrangement effects a biased motion of the cover and thus a cover bias against a graphic sheet and backer board placed on the frame panel. That bias may be different depending upon the thickness of any graphic or backer board, or upon a dimension of the center leg.

That center or hinge leg has a critical transverse width, the size of which effects the aggressiveness of the "snap" and effects the forces that make the J-shaped cover want to rotate beyond the "outer plane" of the backer board, thus applying the bias pressure onto that graphic when that cover has been moved in the direction of that graphic.

An assembly of snap frame members may be cut on the diagonal at their respective ends, and a juncture piece disposed within the T-shaped housing channel to provide "corner-wise" connectivity to the assembly for a full rectilinear enclosure for a backer board and graphic therewithin.

The invention thus comprises an elongated extruded snap frame for biasedly, removably capturing a display graphic for support and display thereof, comprising an elongated extruded frame receiving panel, an elongated strip of securement material applied to the frame panel, an articulable housing comprised of a cover and a plurality of articulable legs co-extruded with one another and connected to one another by a flexible web of material. A further flexible web of material connects the cover to a portion of the articulable housing, the further web of flexible material providing an axis of rotation for the cover when the cover is biasedly rotated onto the display graphic. The legs may be rotated with respect to one another from a generally perpendicular configuration to a generally parallel configuration. The cover may have an elongated distal leg thereon with an elongated co-extruded compressible edge for biasing against the display graphic. The housing may include a "T" shaped slot for providing connection means between adjacent snap frame members. A backer board may be adhesively attachable to the securement material on the frame panel. The graphic display is preferably arranged upon the backer board. The compressible edge of the distal leg has a biased closed position beyond a plane of the graphic display.

The invention also comprises a method of displaying a graphic display sheet comprising one or more of the following steps including: extruding a plastic frame panel from a plastic extrusion machine; co-extruding an articulable, biasable housing along with the frame panel; applying a securement means onto the frame panel co-extensively therewith; cutting the frame panels to the desired size and attaching a backer board and display sheet onto the securement means on the frame panel; and rotating the articulable, biasable housing about a flexible web of material so as to bias a distal portion of the housing onto the display sheet. The method may include: rotating a plurality of interconnected legs about a pair of flexible web hinges from a non-parallel configuration to generally parallel configuration. The biasable housing may include a plurality of interconnected legs.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
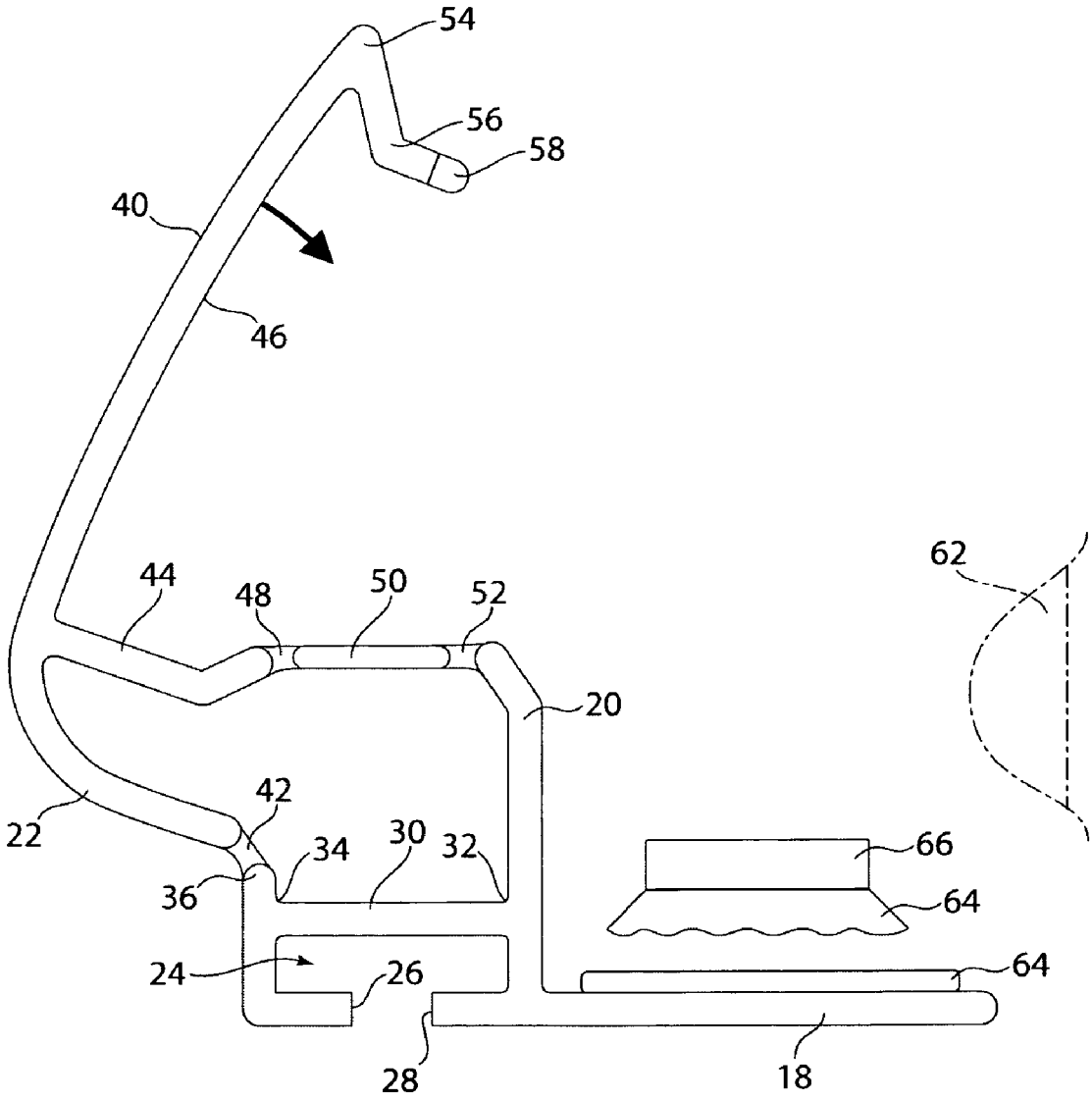
FIG. 1 is an end view of a snap frame as it is extruded from an extrusion machine.
Figure 2:
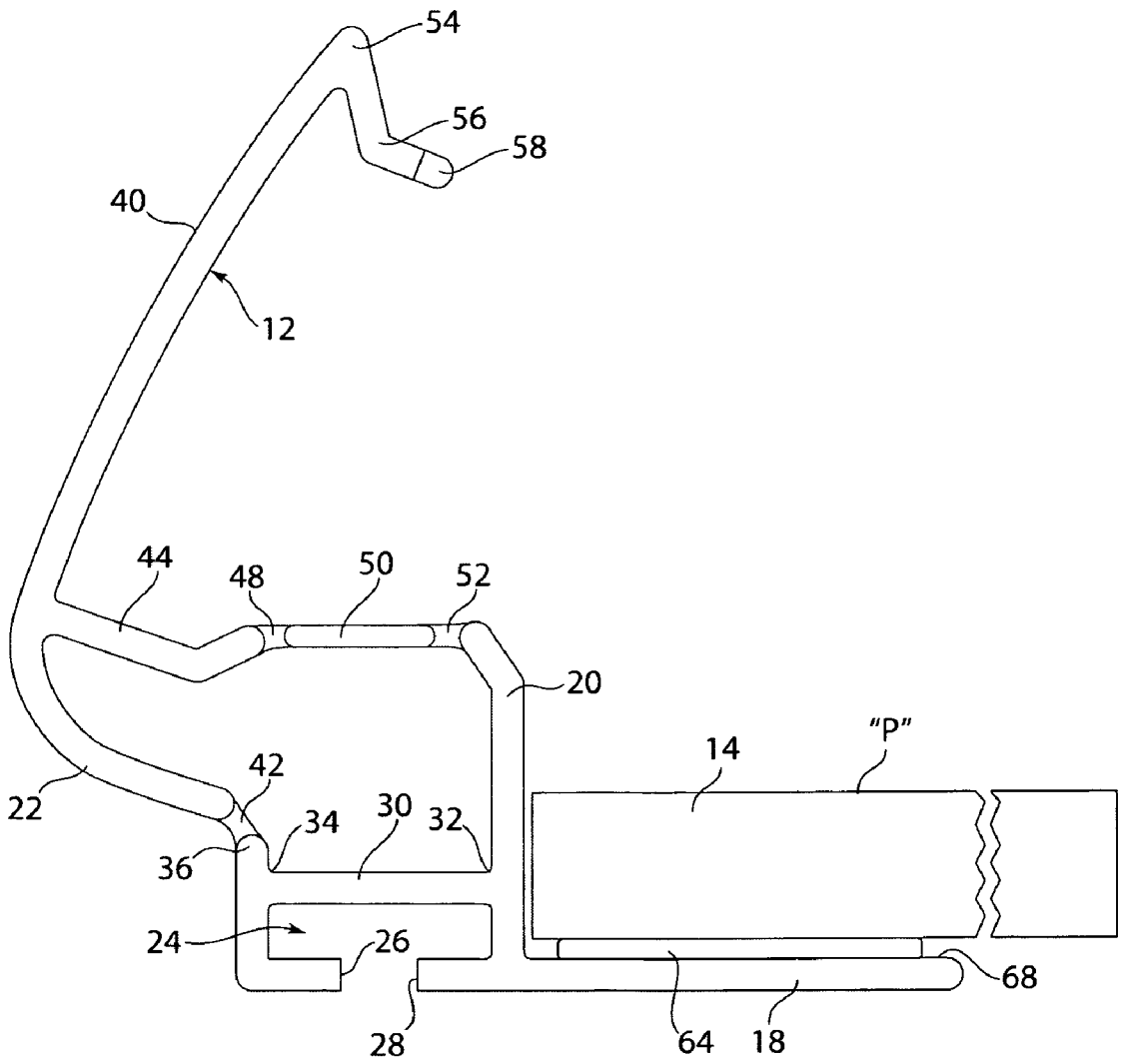
FIG. 2 is a view similar to FIG. 1 showing the snap frame with a backer board applied to its adhesive material on the frame panel.
Figure 2A:
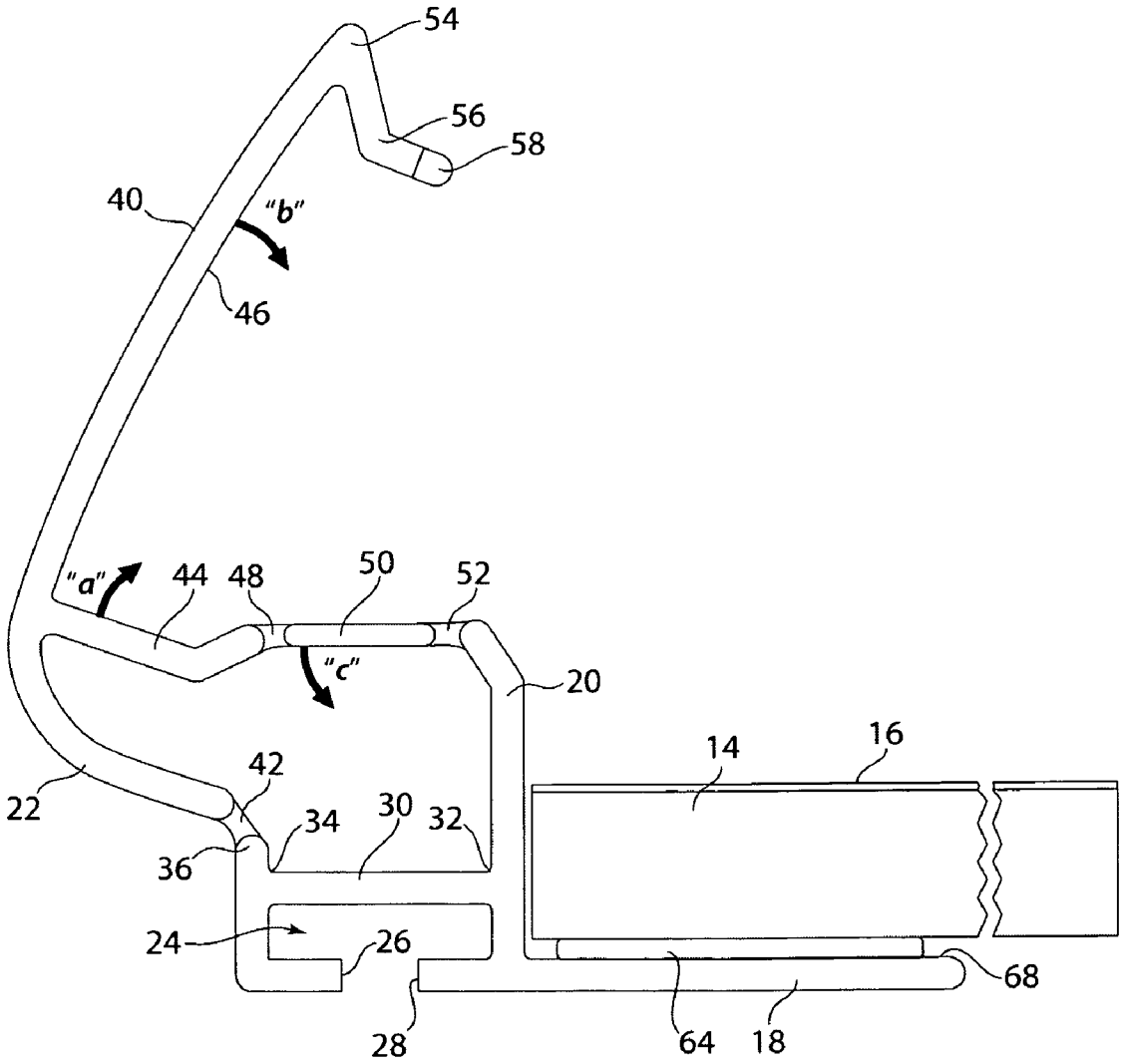
FIG. 2A is a view similar to FIG. 2, with a graphic sheet disposed upon the upper or facia surface of the backer panel.
Figure 3:
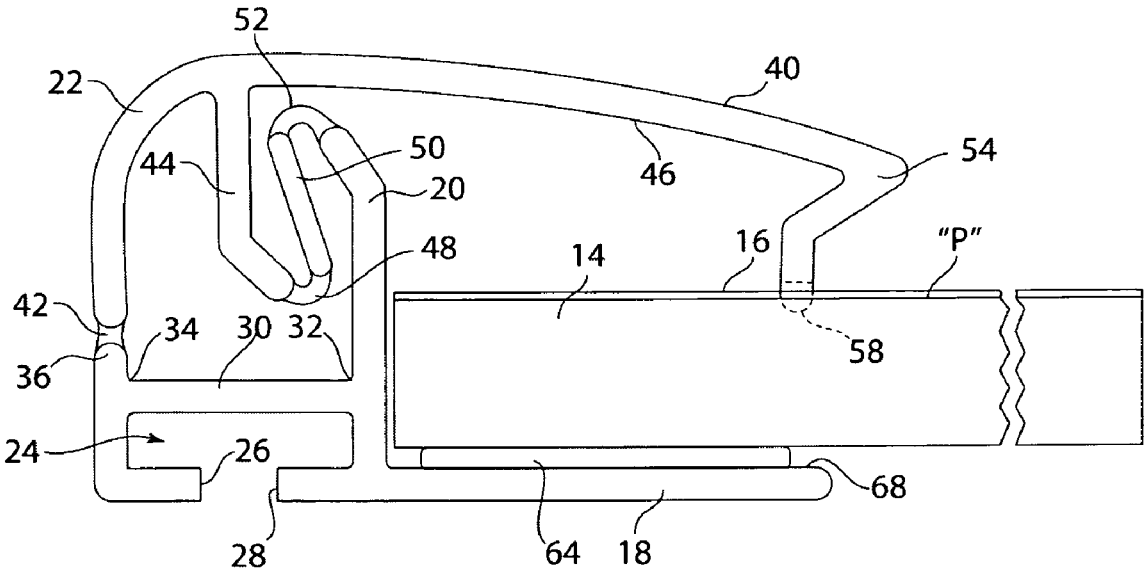
FIG. 3 is an end view of the snap frame, the backer board, and the graphic sheet thereon, with the "J" shaped cover having been pivoted around its axis of rotation, the over now biased against that graphic sheet.
Figure 6:
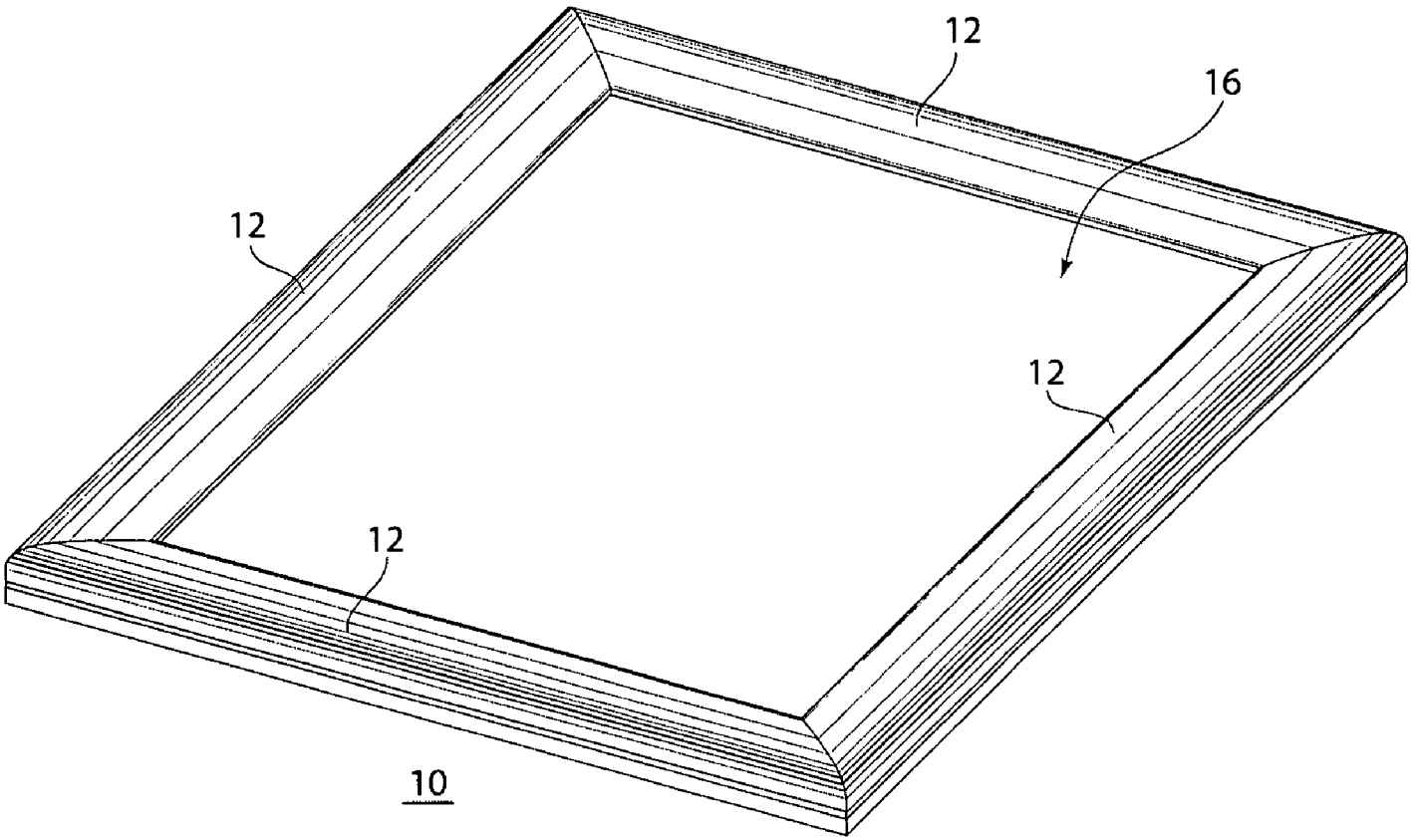
FIG. 6 is a perspective view, similar to that shown in FIG. 4, with the snap frame members having their respective covers all pressed downwardly onto their respective portions of the graphic display.

Referring now to the drawings in detail, and particularly to FIG. 6, there is shown the present invention which comprises a snap frame assembly 10, comprised of multiple snap frame members 12, shown in FIGS. 1, 2, 2A and 3 collectively having a backer board 14 and/or graphic display 16 thereon, shown in FIGS. 2, 2A and 3.

An elongated extruded snap frame member 12, as shown in an end view in FIGS. 1, 2, 2A and 3, comprises an elongated linear frame panel 18 having a co-extruded stationary third leg 20 perpendicular thereto. The frame panel 18 and the third leg 20 comprise a portion of an elongated, hollow housing 22, which also comprises an open-channel 24 of generally "T"-shape in cross section, the open channel 24 being defined by a first flange 26 and a spaced-apart second flange 28, both parallel with an elongated, housing-reinforcing bridging member 30. The bridging member 30 has one elongated side 32 thereof attached to a portion of the third leg 20, the bridging member 30 having a second elongated edge 34 connected to a third flange 36.

A generally "J"-shaped cover 40 is co-extruded with the third flange 36, having a co-extruded first web of flexible material 42 comprising a living hinge therebetween. A first leg 44 extends generally perpendicularly from an inner side 46 of the J-shaped cover 40, and is hingedly coupled by a second flexible web 48 with a center hinge leg 50, and which center hinge leg 50 is also flexibly coupled at its other (second end) by a third flexible web 52, to the distal end of the stationary third leg 20, as represented in FIGS. 1, 2, 2A and 3.

The first leg 44, the third leg 20, and the center (second) hinge leg 50 are all pivotable with respect to one another, as represented by arrows a, b and c, in FIG. 2A, each leg 44, 20 and 50 being connected by their respective flexible webs of material 42, 48 and 52, comprising a trio of elongated joints or living hinges therebetween.

The J-shaped cover member 40 has a distal edge 54 with a distal leg 56 angularly disposed thereon, as represented in FIGS. 1, 2, 2A, and 3. The distal leg 56 has an elongated distalmost edge 58 comprised of flexible compressible material thereon, which edge 58 provides resilience and gripping power thereat, when the cover 40 is in engagement with a graphic display sheet 16, represented for example, in FIG. 2A, discussed hereinbelow.

The elongated snap frame member 12 is preferably manufactured as a one piece co-extrusion, incorporating the flexible hinges along with the rigid material. A layer of securement material 64 is applied to the snap frame member. The securement material 64 is applied to an upper planar portion 68 of the extruded elongated frame panel 18 as the extrusion of the elongated snap frame member 12 occurs. The securement material 64, may for example, comprise an adhesive or a tape or a multi-layer of adhesive and a removable flexible strip cover thereon.

Upon extrusion of a desired length of the snap frame member 12 and application of the securement material 64, the snap frame member 12 are ready to be cut to size in preparation for receiving a graphic display 16 or preferably a backer board 14 thereon. Such backer board 14 may be secured to the adhesive material 64 on the upper or face side of the frame panel 18. A graphic display sheet 16 may be placed upon the uppermost or face surface of the backer board 14 so as to present that display 16 to a viewing public.

Rotation of the cover 40 and particularly the distal edge 54 towards the graphic display 16 and backer board 14 placed on the elongated extruded frame panel 18, as represented in FIG. 3, effects bending of the three webs of flexure material 42, 48 and 52, its axis of rotation of the cover consisting of the first web of flexible material 42 between the proximal end of the J-shaped cover 40 and the third flange 36. The first leg 44 and the center (second) hinge leg 50, during that cover 40 rotation, move from a generally planar configuration as represented in FIGS. 1, 2, 2A, to a "U"-shaped configuration with flexure at its juncture of the webs of flexible material 48 and 52 connectively co-extruded therebetween, as represented in FIG. 3. The center hinge leg 50 flexes with respect to the third leg 20 at its juncture of webbed flexible material 52 therebetween, so as to ultimately come into a generally parallel relationship when the edge material 58 presses against a graphic display 16, as represented in FIG. 3. This simultaneous counter rotational motion of the first leg 44 as indicated by arrow "A" in FIG. 1, with respect to the rotation of the center or second leg 50 rotating in the direction of arrow "C" in FIG. 2A, wherein the center hinge leg 50 and the proximal portion of the "J" shaped cover, 40 pivot about a three point hinge arrangement 42, 48 and 52 to effect a biased "closing" motion of the cover 40 and thus a cover bias against a graphic sheet 16 and backer board 14 placed on the frame panel 18. Those first and second legs 44 and 50 thus go from a generally parallel relationship with one another and from a generally perpendicular relationship with the third leg 20 as represented in FIGS. 1, 2 and 2A in a cover 40 "open" orientation to a generally parallel relationship between all three legs 44, 50 and 20, as represented in FIG. 3, with a cover 40 in a "closed-biased" orientation. The "transverse" length of the middle or second leg 50 thus has a significant factor in the amount bias that the cover 40 exerts upon any graphic 16. By increasing the (transverse) length of that middle leg 50, the bias by the cover 40 may be increased correspondingly.

The center or hinge leg 50 thus has a critical transverse width (or length as depicted from the elevational views of the drawings), the size of which not only effecting the bias but also effects the aggressiveness of the "snap" and effects the forces that make the J-shaped cover 40 want to rotate beyond the "outer plane" "P" of the backer board 14, shown in FIGS. 2 and 3, thus applying the bias pressure onto that graphic 16 when that cover 40 has been moved in the direction of that graphic 16.

Figure 4:
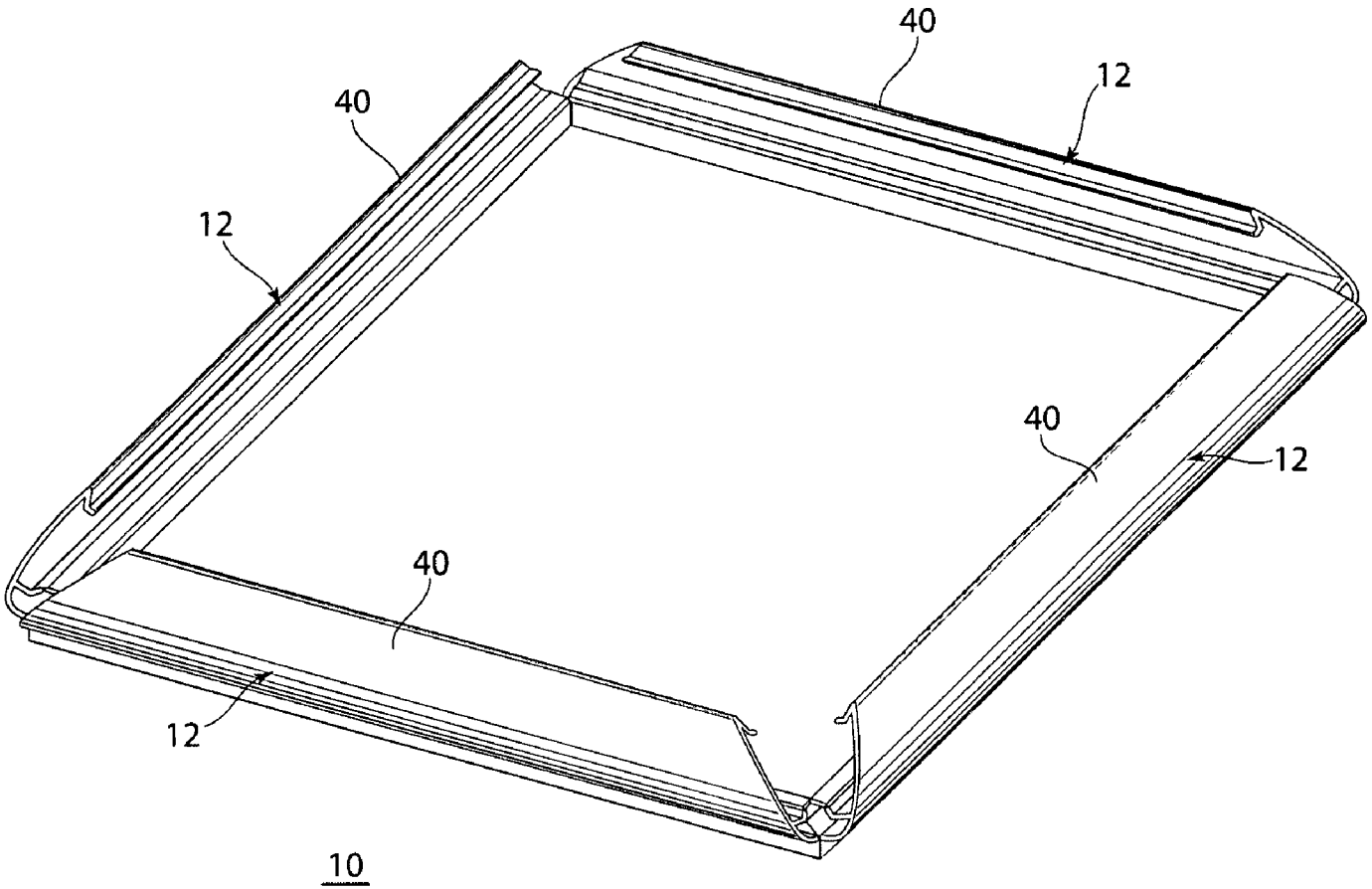
FIG. 4 is a perspective view of a rectilinear assembly of snap frame members with a backer board and graphic display positioned therewithin.
Figure 5:
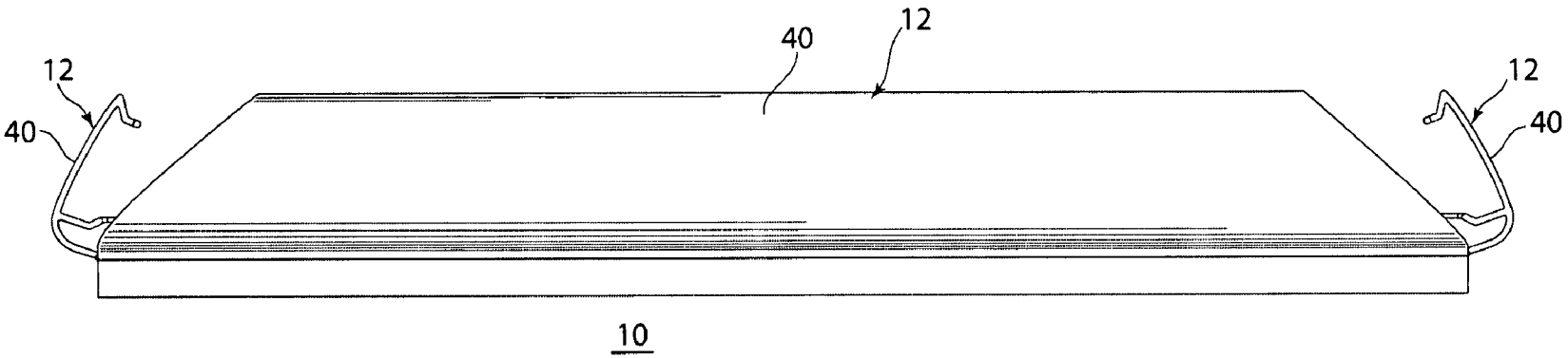
FIG. 5 is an edge view of a rectilinear assembly of snap frame members in their "open" backer board and graphic sheet receiving configuration.

An assembly of snap frame members 12 may be cut on the diagonal at their respective ends, and an "L" shaped connective juncture piece, not shown for clarity, may be disposed within the T-shaped housing channel 24 to provide "cornerwise" connectivity to the snap frame assembly 10 for a full rectilinear enclosure for a backer board and graphic therewithin, as represented in FIGS. 4, 5 and 6.

We claim

1. An elongated extruded snap frame for biasedly removably capturing a display graphic for support and display thereof, comprising:

an elongated extruded frame receiving panel;

an elongated strip of securement material co-extruded onto said frame panel;

an articulable housing comprised of a cover flexibly attached to said frame panel by an elongated flexible hinge, said hinge connected to a third flange on said frame panel, said cover also attached to said frame panel by a first leg fixedly arranged perpendicular to said cover, said first leg flexibly connected to a center leg, said center leg flexibly connected to a third leg, wherein said third leg is rigidly connected to said frame receiving panel, wherein said first leg pivots from a generally in-line or co-planar relationship with respect to said center leg, and wherein both said generally in-line, co-planar first leg and said center leg are arranged generally perpendicular to said third leg when said cover is in an cover-open configuration, said center leg and said third leg being in a generally parallel, transversely adjacent relationship, when said cover is in a cover-closed, graphic-pinching configuration.

2. The elongated extruded snap frame as recited in claim 1, wherein said cover has an elongated distal leg thereon with an elongated co-extruded compressible edge for biasing against said display graphic.

3. The elongated extruded snap frame as recited in claim 1, wherein said housing includes a "T"shaped slot for providing connection means between adjacent snap frame members.

4. The elongated extruded snap frame as recited in claim 1, wherein a backer board is adhesively attachable to said securement material on said frame panel.

5. The elongated extruded snap frame as recited in claim 4, wherein said graphic display is arranged upon said backer board.

6. The elongated extruded snap frame as recited in claim 5, wherein said compressible edge of said distal leg has a biased closed position beyond a plane of said graphic display.

7. A method of displaying a graphic display sheet comprising:

extruding a plastic frame panel from a plastic extrusion machine;

co-extruding an articulable, biasable housing along with said frame panel, said biasable housing comprised of a cover flexibly attached to said frame panel by an elongated first flexible web or hinge, said hinge connected to a third flange on said frame panel, said cover also attached to said frame panel by a first leg fixedly arranged perpendicular to said cover, said first leg flexibly connected to a center leg, said center leg flexibly connected to a third leg, wherein said third leg is rigidly connected to said frame receiving panel;

applying a securement means onto said frame panel co-extensively therewith;

applying a backer board and display sheet onto said securement means on said frame panel; and rotating said articulable, biasable housing about said first flexible web of material so as to bias a distal portion of said housing onto said display sheet, by pivoting said first leg from a generally in-line or co-planar relationship with respect to said center leg, wherein both said generally in-line, co-planar first leg and said center leg are arranged generally perpendicular to said third leg when said cover is in an cover-open configuration, into a configuration wherein said first leg, said center leg and said third leg being concurrently moved into a generally parallel, transversely adjacent relationship, when said cover is moved into a cover-closed, graphic display sheet-pinching configuration.

8. An elongated extruded snap frame for biasedly capturing a removable display graphic for support and display thereof, comprising:

an elongated extruded frame receiving panel;

an elongated strip of securement material co-extruded onto the frame panel;

an articulable housing comprised of a movable cover flexibly attached to the frame panel by an elongated flexible first hinge along one edge of the cover, wherein the first hinge is connected to a the frame panel at a third flange on the frame panel;

the movable cover also attached to the frame panel by a first leg fixedly arranged perpendicular to the movable cover, the first leg being flexibly connected to a center leg by a second hinge, the center leg being flexibly connected to a third leg by a third hinge, wherein the third leg is also rigidly connected to the frame panel, wherein the first leg is pivotable from a generally in-line or co-planar relationship with respect to the center leg, and wherein both the generally in-line, co-planar first leg and the center leg are arranged generally perpendicular to the third leg when the movable cover is in an "cover-open-"configuration, and the first leg, the center leg and the third leg being movable into a generally parallel, transversely-adjacent relationship, when the center leg is pivotable about both the second hinge and the third hinge so that the movable cover is pivoted about the first hinge and into a "cover-closed", "graphic-pinching"configuration.

* * * * *